US006116200A

United States Patent [19]

Abts et al.

[11] Patent Number: 6,116,200

[45] Date of Patent: Sep. 12, 2000

[54] SYSTEM FOR ANGULAR ADJUSTMENT OF A SHAFT RELATIVE TO A DRIVING GEAR

[75] Inventors: Manfred Abts, Odenthal; Rudolf Menne, Bergisch Gladbach; Roger Wildemann, Wermelskirchen; Thomas Koob, Cologne, all of Germany

[73] Assignee: Ford Global Technologies, Inc., Dearborn, Mich.

[21] Appl. No.: 09/242,074

[22] PCT Filed: Jul. 22, 1997

[86] PCT No.: PCT/EP97/03943

§ 371 Date: May 10, 1999

§ 102(e) Date: May 10, 1999

[87] PCT Pub. No.: WO98/07966

PCT Pub. Date: Feb. 26, 1998

[30] Foreign Application Priority Data

Aug. 21, 1996 [DE] Germany ..... 196 33 640

[51] Int. Cl.[7] ..... F01L 1/344

[52] U.S. Cl. ..... 123/90.17; 123/90.37; 123/90.38; 74/568 R; 464/2; 464/160

[58] Field of Search ..... 123/90.15, 90.17, 123/90.31, 90.33, 90.34, 90.37, 90.38; 74/568 R; 464/1, 2, 160

[56] References Cited

U.S. PATENT DOCUMENTS

| | | | |
|---|---|---|---|
| 4,627,825 | 12/1986 | Bruss et al. | 464/2 |
| 4,787,345 | 11/1988 | Thoma | 123/90.17 |
| 5,189,999 | 3/1993 | Thoma | 123/90.17 |
| 5,301,639 | 4/1994 | Satou | 123/90.17 |
| 5,377,638 | 1/1995 | Mueller | 123/90.17 |
| 5,474,038 | 12/1995 | Golovatai-Schmidt et al. | 123/90.17 |
| 5,540,197 | 7/1996 | Golovatai-Schmidt et al. | 123/90.17 |
| 5,566,651 | 10/1996 | Strauss et al. | 123/90.17 |

FOREIGN PATENT DOCUMENTS 147209 7/1985 European Pat. Off. .

*Primary Examiner*—Weilun Lo
*Attorney, Agent, or Firm*—Jerome R. Drouillard

[57] ABSTRACT

A system for angular adjustment of a shaft relative to a driving gear, preferably of a camshaft of an internal combustion engine, includes a hydraulically controllable angular adjustment device rotating with the shaft and having hydraulic supply ducts in a non-rotatably fitted end cap and oil distribution ducts, associated with the supply ducts, in the angular adjustment device. The end cap is provided in its inner circumferential region facing the direction of adjustment with at least one recess shaped to receive an oil distribution ring. The oil distribution ring is shaped so as to be connectable non-rotatably to the end ring and to be movable transverse to the common axial direction, and the internal diameter of the recess is greater than the external diameter of the oil distribution ring. Through the movability of the oil distribution ring relative to the end cap, deviations between the position of the camshaft, which determines the position of the oil distribution ring, and the position of the end cap can be compensated for during assembly of the system. Furthermore, in order to form two separate oil supply ducts it can be provided that the internal circumference of the end cap and the external circumference of the oil distribution ring are stepped.

6 Claims, 1 Drawing Sheet

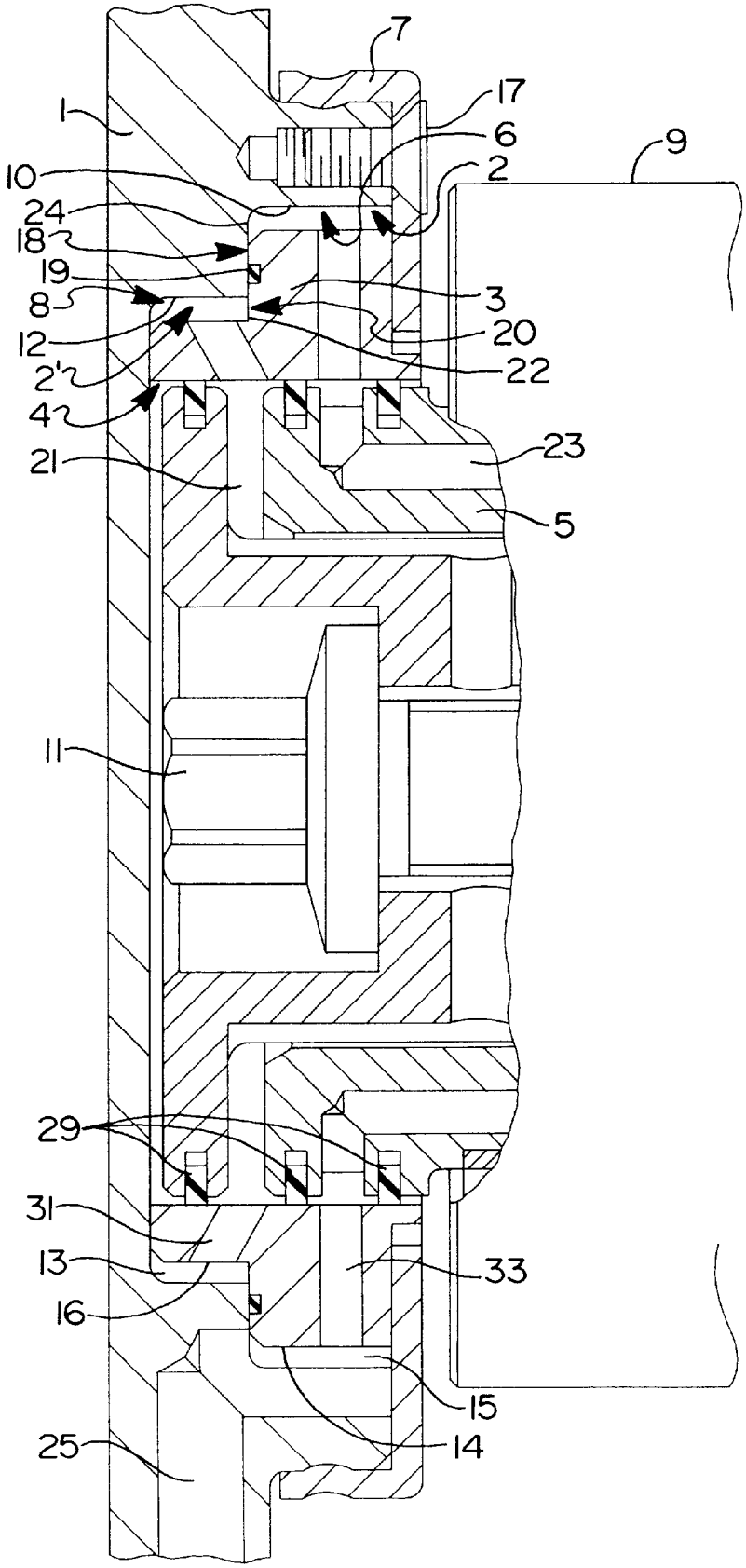
7
17
1
6
9
10
2
24
18
19
3
8
20
12
22
2'
4
23
21
5
11
29
31
13
33
16
15
14
25

SYSTEM FOR ANGULAR ADJUSTMENT OF A SHAFT RELATIVE TO A DRIVING GEAR

FIELD OF THE INVENTION

The invention relates to a system for angular adjustment of a shaft relative to a driving gear, preferably of a camshaft of an internal combustion engine, comprising a hydraulically controllable angular adjustment device rotating with the shaft and having hydraulic supply ducts in a non-rotatably fitted end cap and oil distribution ducts, associated with the supply ducts, in the angular adjustment device.

BACKGROUND OF THE INVENTION AND PRIOR ART

Such angular adjustment systems known as VCT (variable cam timing) systems, are often used in internal combustion engines to displace the position of the camshaft in relation to the crankshaft. The phase shift of the valve opening and closing times that is possible by the angular adjustment enables the valve timing to be optimised with respect to the nominal output, torque, fuel consumption and exhaust gas emission requirements of the engine.

The angular adjustment is mostly performed hydraulically by means of an internal adjusting device fitted in the camshaft driving unit. For this purpose a helical gear is fitted between the chain wheel and the camshaft, and a hydraulic piston effects an axial displacement of the helically toothed element such that an angular displacement results between the driving gear and the camshaft. The form of the adjusting device can be such that advancing or retarding of the valve timing is brought about through two alternately pressurised hydraulic ducts. The valve elements required for the control are suitably located in the non-rotating part of the system. Alternatively the control can be effected through only a single hydraulic duct through which the angular adjustment in one direction takes place, while the angular adjustment in the other direction is effected by means of a return spring.

A characteristic feature of the hydraulic adjusting devices usually used is that they are connected to the rotating camshaft. The hydraulic fluid must be supplied to the rotating adjusting device from a non-rotating hydraulic supply. For this purpose in the known systems a non-rotating end cap is provided which has a recess in it for a rotating oil distribution device. Both in the end cap and in the rotating oil distribution device at least one oil distribution duct is provided which, in the transition region between the non-rotating and the rotating elements, changes into at least one annular duct. Elastic sealing elements are provided for sealing of the annular ducts between the end cap and the rotating oil distribution device. Since the end cap is connected to the camshaft so as to rotate therewith, it is centred on the camshaft. At the same time the end cap forms a portion of the outer side wall of the engine block. The outer side wall is connected at its upper face to the cylinder head cover of the engine, and the upper edge of the outer wall must be in alignment with the cylinder head cover in order to ensure the oil-tightness of the outer wall of the engine block.

The position of the cylinder head cover relative to the axis of the camshaft is subject to quite large manufacturing tolerances arising in mass production. These tolerances affect the position of the outer side wall fitted to the cylinder head cover. For this reason in the prior art the outer side wall is made up of two parts, one being the end cap and the other the side housing. The side housing has a recess to receive the end cap, the rim of the end cap being secured on the outside of the side housing, for example by means of a screw connection, in such a way that deviations in the relative position of the side housing and the end cap can be compensated during assembly. Between the side housing and the end cap an elastic sealing element is provided in order to prevent loss of oil.

However, during the lifetime of the engine each sealing element needed on the outer housing of the engine block can become leaky, and consequently represents a possible source of problems which give rise to maintenance and repair costs. In addition the length of the engine block is increased through the end cap projecting beyond the external profile of the side housing, which could be avoided by a one-piece design of the side wall.

Object of the Invention

An object of the invention is to provide an angular adjustment device of the aforementioned kind which is as easy as possible to fit and in which the outer side wall is formed in one piece with the end cap while at the same time ensuring the necessary adjustment for tolerances between the position of the side wall and the camshaft axis.

The Invention

To this end, in accordance with the invention the end cap has, in its inner circumferential region facing the direction of adjustment, at least one recess shaped to receive an oil distribution ring, the oil distribution ring is shaped so as to be connectable non-rotatably to the end cap and is arranged to be movable transverse to the common axial direction, the internal diameter of the recess is greater than the external diameter of the oil distribution ring, and the oil distribution ring has radially extending passages distributed around its circumference.

Fitting the non-rotatable oil distribution ring inside the non-rotatable end cap so as to be movable transverse to the common axial direction makes it possible to achieve the necessary compensation of tolerances by a movement of the oil distribution ring relative to the end cap. Consequently in accordance with the invention the end cap can be formed so that at the same time it forms the side housing of the engine block which at its upper end face is in alignment with the cylinder block head.

Between the outer circumference of the oil distribution ring and the inner circumference of the end cap an annular gap is formed, the diameter of which is adapted to the maximum tolerances that have to be compensated for. If the oil distribution ring is moved, the end cap and the oil distribution ring are in general no longer lined up concentrically with one another, so that the annular gap is then narrower at one side and wider at the other.

The supply of the hydraulic oil to the angular adjustment device takes place through ducts formed within the end cap first of all into the annular gap between the end cap and the outer circumference of the oil distribution ring. From here the oil passes through the radially extending passages provided in the oil distribution ring into the annular gap between the oil distribution ring and the rotating oil distribution device. In the oil distributing device the oil is supplied through ducts in the angular adjustment device.

If two hydraulic ducts are used for control of the angular adjustment device, it is provided in accordance with the invention that the end cap has in its inner circumferential region, facing the direction of adjustment, two recesses having different diameters and forming a step and the oil distribution ring has a similarly stepped form at its outer circumference, the internal diameters of the recesses being greater than the associated external diameters of the stepped oil distribution ring, so that two annular ducts are formed which are separated from one another. The stepped form of the inner circumference of the end cap and the outer circumference of the oil distribution ring enables two annular ducts, separated from one another, to be formed, the separation being effected by the mutually contacting flanks of the steps on the end cap and on the oil distribution ring. The separation of the ducts is necessary since leaks between the ducts impair the functioning of the angular adjustment. Separate ducts for the hydraulic oil are similarly provided in the end cap, the oil distribution ring and the oil distribution element.

In a further embodiment of the invention an annular sealing element is provided between the flanks of the stepped oil distribution ring and the flanks of the stepped end cap. This sealing element gives additional sealing of the two ducts from one another.

According to another embodiment of the invention the end cap can have on its side facing the camshaft a radially inwardly extending retaining device for the oil distribution ring. After the oil distribution ring has been fitted the retaining device is attached by means of a snap fastening on the side of the end cap facing the camshaft. A screw can be provided for additional security. The retaining device serves firstly to fix the oil distribution ring in its axial position and secondly to close the side of the annular gap between the end cap and the oil distribution ring.

According to yet another embodiment of the invention a retaining pin is provided to prevent any rotary movement of the oil distribution ring. The retaining pin is either located on a non-rotating part of the housing and engages in a recess in the oil distribution ring, or the retaining pin is provided on the oil distribution ring and engages in a recess in the end cap. The recess is of such a size that the movement provided in accordance with the invention transverse to the common axial direction between the end cap and the oil distribution ring to produce the required tolerance compensation is possible.

BRIEF DESCRIPTION OF THE DRAWING

The invention will now be described in more detail, by way of example, with reference to an embodiment shown in the drawing, in which the only Figure shows a sectional view of the arrangement of the end cap of an angular adjustment system in accordance with the invention.

DETAILED DESCRIPTION OF A PREFERRED EMBODIMENT OF THE INVENTION

A non-rotatably arranged end cap 1 has a pair of recesses 2,2' which receive a likewise non-rotatably arranged oil distribution ring 3. The oil distribution ring 3 in turn has a recess 4 in which a rotating oil distribution device 5 is fitted. This device 5 is connected non-rotatably to the camshaft (not shown) by a screw 11. The oil distribution ring 3 is held in position by a retaining device 7 which is snapped on to the end cap 1 and additionally fixed by a screw 17. The oil distribution ring 3, the rotating oil distribution device 5 and the retaining device 7 are substantially rotation-symmetrical in form. Adjoining the oil distribution device there is a housing 9 for a hydraulically controlled angular adjustment device (not shown) for adjusting the angle between the camshaft and a driving gear (likewise not shown). The end cap 1 forms the outer side wall of the engine block and at its upper end face (not shown) and terminates flush with the cylinder head cover (likewise not shown).

To control the angular adjustment device, which rotates with the camshaft, two hydraulic ducts 25 and the second not visible are provided which are alternately pressurised with hydraulic oil in order to effect an advancing or retarding adjustment. For this purpose the hydraulic ducts have associated with them two electrically controllable valves, located in the non-rotating part of the system, which, depending on the valve setting, either supply the respective hydraulic duct with pressurised oil or connect it to a pressureless oil drain line. To separate the hydraulic ducts the end cap 1 is stepped 18 at its inner circumference 6 and the oil distribution ring 3 is stepped 20 at its outer circumference 8. The internal diameters 10, 12 adjacent the stepped portion 18 of the end cap 1 are greater than the external diameters 14, 16, respectively, adjacent the associated stepped portion 20 of the oil distribution ring 3, so that annular gaps 13, 15 are formed between the end cap 1 and the oil distribution ring 3. The annular gaps 13, 15 make it possible to move the end cap 1 and the oil distribution ring 3 during assembly relative to one another transverse to their common axial direction, in order to compensate manufacturing tolerances between the position of the camshaft and the position of the end cap 1, which is determined by the position of the cylinder head cover. The stepped portions 18, 20, form radially extending surfaces 24, 22, respectively, on the end cap 1 and oil distribution ring 3. Between the radially extending surfaces 24 and 22 of the end cap 1 and the oil distribution ring 3, an annular sealing element 19 is fitted.

The two hydraulic ducts proceeding from the valves open into the respective annular gaps 13 and 15, in the one case through a duct 25 in the end cap and in the other case through a duct which runs within the end cap but is not visible in the drawing. Through radial passages 31, 33 in the oil distribution ring 3 the oil passes into the ducts 21, 23 in the rotating oil distribution device 5 and through these to the angular adjustment device. Sealing elements 29 are fitted between the oil distribution ring and the rotating oil distribution device to provide seals between the ducts 31, 21 and 33, 23.

While a presently preferred embodiment has been illustrated and described, it is to be appreciated that the invention may be practiced in various forms within the scope of the following claims.

What is claimed is:

1. A system for angular adjustment of a camshaft relative to a driving gear of an internal combustion engine, the system including a hydraulically controllable angular adjustment device having hydraulic supply ducts, the adjustment device rotating with the shaft about an axis, the system comprising:

a non-rotatably fitted end cap having oil distribution ducts associated with the hydraulic supply ducts in the adjustment device, and in fluid communication therewith, the end cap having a recess with an inner circumference; and an oil distribution ring having an outer surface having an outside diameter, the oil distribution ring fitted within the recess of the end cap, the oil distribution ring being non-rotatably connected to the end cap and movable transverse to the axis, the internal diameter of the recess being greater dimension than the external diameter of the oil distribution ring, the oil distribution ring further having radially extending passages for connecting the distribution ducts with the supply ducts.

2. A system according to claim 1, further comprising:

the end cap having a second recess formed within the first recess provided therein, the second recess having a smaller inside diameter than the first inside diameter of the first recess, thereby forming a step; and the oil distribution ring having a corresponding second step formed at its outer surface having a second outside diameter, the internal diameters of the recesses being greater than the corresponding external diameters of the stepped portion of the oil distribution ring, thereby forming two annular ducts between the respective inside and outside diameters after the end cap is positioned adjacent the oil distribution ring.

3. A system according to claim 2, further comprising:

each of said end cap and oil distribution ring having a respective radial surface formed at the stepped portion thereof;

an annular sealing element provided between the radial surfaces of the oil distribution ring and the end cap.

4. A system according to claim 1, further comprising the end cap having a radially inwardly extending retaining device for retaining the oil distribution ring.

5. A system according to claim 2, further comprising the end cap having a radially inwardly extending retaining device for retaining the oil distribution ring.

6. A system according to claim 3, further comprising the end cap having a radially inwardly extending retaining device for retaining the oil distribution ring.

* * * * *